United States Patent [19]

Brown et al.

[11] Patent Number: 4,895,527

[45] Date of Patent: Jan. 23, 1990

[54] SAFETY COVER

[76] Inventors: Martin C. Brown, 7216 Balmoral Dr., Columbia, S.C. 29209; Peter M. Brown, 107 Birch Trail, Greenwood, S.C. 29649

[21] Appl. No.: 354,790

[22] Filed: May 22, 1989

[51] Int. Cl.[4] ..... H01R 13/44

[52] U.S. Cl. ..... 439/147; 439/332

[58] Field of Search ..... 439/332, 147, 135, 142, 439/140, 137, 312, 308, 309

[56] References Cited

U.S. PATENT DOCUMENTS

| | | | |
|---|---|---|---|
| 2,092,904 | 9/1937 | Brugger | 439/312 |
| 2,462,756 | 2/1949 | Leopold | 439/137 |
| 2,526,606 | 10/1950 | Gregg | 174/67 |
| 2,722,665 | 11/1955 | Sauder | 439/135 |
| 2,761,112 | 8/1956 | Torcivia | 439/147 |
| 2,892,172 | 6/1959 | McGann, Jr. | 439/135 |
| 2,934,591 | 4/1960 | Tiikkainen | 439/135 X |
| 2,987,690 | 6/1961 | Marbais | 439/135 |
| 3,363,216 | 1/1968 | Benedetto | 439/147 |
| 3,601,757 | 8/1971 | Gober | 439/147 |
| 3,656,083 | 4/1972 | Brook | 439/147 |
| 3,811,104 | 5/1974 | Caldwell | 439/135 |
| 4,076,360 | 2/1978 | Singh | 439/147 |
| 4,083,618 | 4/1978 | Busch, Jr. | 439/147 |
| 4,531,800 | 7/1985 | Avener | 439/373 |
| 4,586,765 | 5/1986 | Ban | 439/142 |
| 4,605,270 | 8/1986 | Aslizadeh | 439/140 |
| 4,671,587 | 6/1987 | Lerner et al. | 439/142 |
| 4,691,974 | 9/1987 | Pinkerton et al. | 439/147 |
| 4,718,856 | 1/1988 | Pinkerton et al. | 439/147 |
| 4,725,245 | 2/1988 | Shea | 439/332 |
| 4,793,818 | 12/1988 | Poirier | 439/135 X |

FOREIGN PATENT DOCUMENTS

| | | | |
|---|---|---|---|
| 1198670 | 7/1970 | United Kingdom | 439/135 |

*Primary Examiner*—William Briggs

*Attorney, Agent, or Firm*—Dennison, Meserole, Pollack & Scheiner

[57] ABSTRACT

A safety cover for a dual outlet receptacle including a planar peripheral base edge, a central face panel offset laterally from the base edge and integrally jointed thereto by peripheral side panels. The face panel is inclined to define a tapered chamber of approximately maximum depth over one outlet and minimal depth over the second outlet. An elongate aperture is defined through the face panel at a position generally corresponding to the maximum depth of the chamber and is configured to allow passage of the plug in one rotated position thereof and to preclude retraction of the plug upon rotational alignment of the plug for engagement with the corresponding outlet. The second aperture through the face panel is of a size, and so aligned with the second outlet, as to allow for direct engagement of a plug therethrough and into the outlet. Alternatively, the cover can have a chamber of constant depth and both apertures configured to require rotational manipulation of both plugs for passage through the apertures and subsequent rotation for engagement within the aligned receptacle outlets.

13 Claims, 1 Drawing Sheet

SAFETY COVER

BACKGROUND OF THE INVENTION

The potential danger of electrical shock from conventional plug-receiving electrical wall receptacles, arising primarily from failure to maintain the plug properly seated in the outlet, is well known. The problem is particularly acute when young children are present in that the plug with extending wire is readily grasped and pulled.

This problem has attracted much attention, and a large body of art has been developed directed to preventing accidental removal or partial removal of an appliance plug from an electrical outlet, particularly by young children. In connection therewith, safety covers have been devised for closing unused outlets, locking plugs within outlets, requiring specific plug manipulation for insertion and removal, and the like.

Examples of known devices will be seen in the patents to Brook, 3,656,083; Busch, Jr., 4,083,618; and Avener, 4,531,800. In each instance, the individual plugs are retained within the receptacle by cover means which are adapted to be opened or removable by a simple manipulation of the cover or a portion thereof. In Brook and Avener, a specifically configured receptacle face plate is required to mount the cover element.

SUMMARY OF THE INVENTION

The safety cover of the present invention is unique in its effectiveness in securing a outlet-engaged plug, its adaptability in use with a conventional duplex outlet receptacle for locking one plug within one outlet while providing for free access to the second outlet, and in its aesthetic appearance for use in a home environment.

The safety cover of the invention is adapted for use with a dual outlet receptacle, mounting thereover and completely enclosing the conventional receptacle face plate. The cover includes an outwardly offset face panel defining an elongate chamber aligned over the two receptacle outlets. The face panel includes a pair of plug-passing apertures which, upon a mounting of the safety cover, overlie the outlets. At least one of the apertures is elongate and configured to accept a conventional plug in only an aligned position which is rotationally offset from the orientation of the plug required for insertion into the corresponding outlet. Thus, when utilizing the safety cover, an engagement of the plug requires an insertion of the plug through the corresponding aperture, a rotation of the plug for engagement into the corresponding outlet, an engagement of the plug, and a mounting of the safety cover.

The safety cover will include a central screw hole which aligns with the screw hole of the conventional face plate for a mounting of the safety cover, along with the face plate itself, by either a single elongate mounting screw, or preferably by an intermediate extension member which engages through the face plate in place of the mounting screw thereof and which presents a projecting internally threaded head into which the safety cover mounting screw engages. The provision of such an extension is also desirable in providing for additional stabilization to the safety cover.

Upon a mounting of the safety cover, the defined chamber, relative to the receptacle face plate, is of a depth so as to preclude withdrawal, and preferable even partial withdrawal, of the plug from the outlet. In this manner, accidental partial exposure of the plug blades is avoided, both by the plug-surrounding housing defined by the cover, and the actual engagement of the cover with the plug to prevent its withdrawal.

In the preferred embodiment, the chamber is tapered from a greater depth, sufficient to confine and retain a plug, aligned with one of the receptacle outlets to a substantially reduced depth over the second outlet with the aligned aperture being of a size to accommodate passage of a plug directly therethrough and into the second outlet. In this manner, and notwithstanding the locking of a first plug within an outlet by the safety cover, the cover simultaneously provides for free access to the second outlet of a dual receptacle for use in a conventional manner for appliances used on a temporary basis, such as vacuum cleaners, hair dryers, and the like.

In another embodiment, both apertures through the safety cover can require plug rotation and plug engagement prior to a mounting of the safety cover for a retention of both plugs.

Further features and advantages of the invention will become apparent from the more detailed description of the invention following hereinafter.

DESCRIPTION OF PREFERRED EMBODIMENTS

Referring now more specifically to the drawings, the safety cover 10 of the invention is of a rigid one-piece construction and mounts over an existing face plate 12 of a duplex receptacle conventionally mounted to a wall 14.

Figure 4:
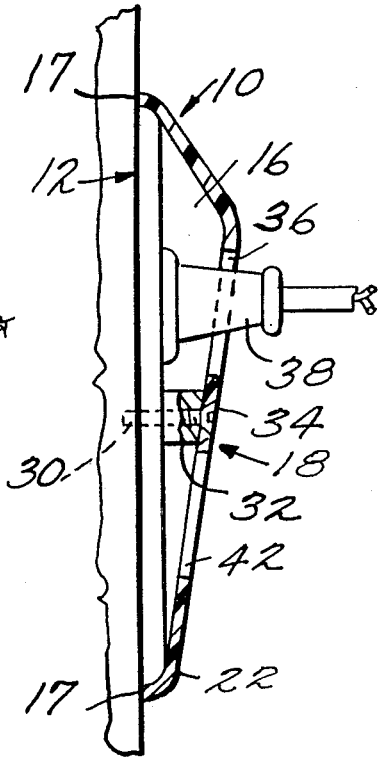
FIG. 4 is an enlarged cross-sectional view taken substantially on a plane passing along line 4—4 in FIG. 2.

The cover 10, normally rectangular, is configured to define a hollow chamber 16 over the existing face plate 12, as best illustrated in FIG. 4, and includes a peripheral base 17 which engages the wall 14 closely about the existing face plate 12 to provide for a complete covering or enclosing thereof.

The chamber 16 is formed by a face or top panel 18 outwardly offset from the planar peripheral base or base edge 17 and by peripheral panels integral and coextensive with the edges of the face panel 18 and extending therefrom to the peripheral base 17. The peripheral panels include upper and lower panels 20 and 22 respectively, and opposed side panels 24. The face panel 18, while dimensionally smaller than the base 17, is of a size so as to provide a common planar surface overlying both receptacle outlets 26. The peripheral panels 20, 22 and 24 are inclined between the peripheral base 17 and the edges of the face panel 18.

Figure 1:
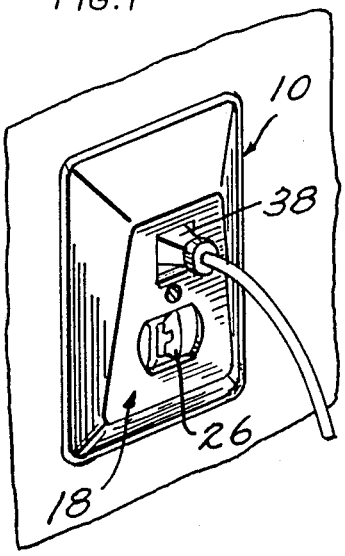
FIG. 1 is a front perspective view of the safety cover of the invention, wall-mounted and retaining a single plug.
Figure 2:
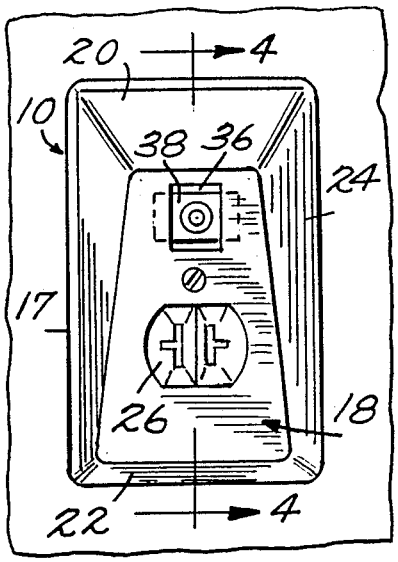
FIG. 2 is a front elevational view of the wall-mounted cover.
Figure 3:
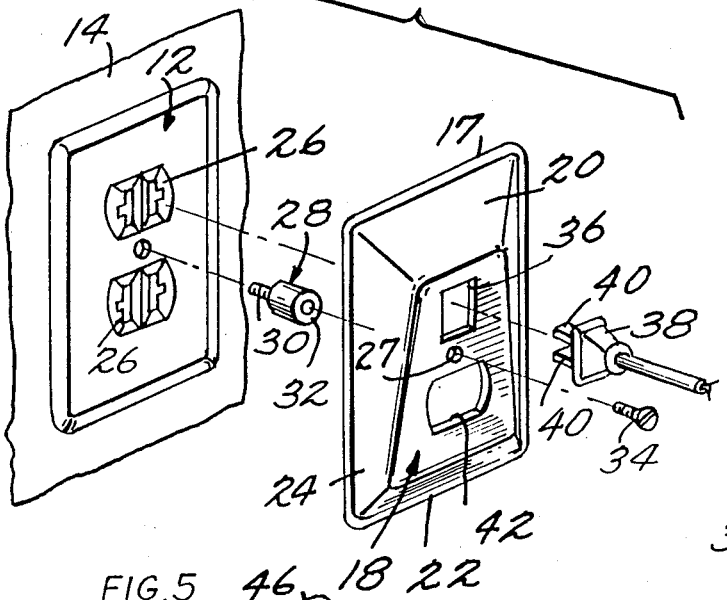
FIG. 3 is a perspective view illustrating the safety cover and mounting means thereof exploded from the wall receptacle.

Noting FIG. 4 in particular, the chamber 16 is tapered from a substantially maximum depth overlying one receptacle outlet to a substantially lesser depth overlying the second outlet. The tapered chamber 16 is defined by an inclined orientation of the face panel 18 with the face panel, noting FIG. 2 in particular, having a general trapezoidal configuration dimensionally less than the rectangular base edge 17. The upper peripheral panel 20, extending from the end of the chamber adjacent the greatest depth thereof, is similarly of greater depth than the lower peripheral panel 22.

The safety cover 10 includes a central screw hole 27 which aligns with the face plate screw hole upon a positioning of the safety cover 10. The actual mounting of the safety cover can be affected by a removal of the face plate mounting screw and the substitution therefor of a single elongate screw extending through both the safety cover screw hole 27 and the face plate screw hole. Alternatively, and as illustrated, an extension member 28, including a threaded shank 30 and enlarged internally threaded cylindrical head 32 can be utilized. The threaded shank 30, as noted particularly in FIG. 4, will engage through the face plate screw opening for a securement of the face plate in the conventional manner. The cover plate 10, in turn, will mount to the head 32 utilizing the conventional plate mounting screw 34. The head 32 will be of a length corresponding to the depth of the chamber 16 at the central location thereof, thereby adding to the stabilization and rigidity of the cover 10.

An elongate opening or aperture 36, normally rectangular and vertically directed, is formed through the upper portion of the face panel 18 in alignment with the upper receptacle outlet 26. The elongate configuration of this aperture 36 is such as to accommodate a conventional appliance plug 38 therethrough only upon specific rotational alignment of the plug with the aperture. More specifically, the modern day conventional plug has a elongate or oblong cross-sectional configuration with the plug blades 40 spaced therealong in parallel relation to each other whereby one grasping the plug is immediately aware of the blade orientation for ease of plug insertion and removal. The aperture 36 in turn is of a complementary configuration to allow passage of the plug only upon longitudinal alignment of the major axis of the plug 38 with the major axis of the aperture 36.

In use of the cover 10, the plug 38 is aligned with the opening or aperture 36 and inserted through the aperture. Once extended through the aperture, the plug 38 is rotated to align the blades 40 with the sockets of the corresponding outlet 26, the plug and more particularly the blades 40 thereof are seated within the socket, and the cover fixedly mounted utilizing the appropriate screw means. As will be recognized, the utilization of separate screw means, in the nature of a conventional screw 34 requires the use of a separate tool, i.e., a screw driver, for both a mounting of the cover plate, and more importantly for a removal of the cover plate. Thus, the possibility of the cover plate itself being accidentally opened or removed is completely eliminated.

The size of the aperture 36 through the face panel 18 is such as to require an exact alignment of the plug with the aperture. Any rotation of the plug out of alignment with the aperture 36 makes it impossible to withdraw the plug 38. As will be noted in the drawings, the preferred rotational offset of the aperture 36 from the conventional position of the outlet-engaged plug 38 is 90 degrees.

The depth of the chamber 16 which receives the plug 38 to be retained by the cover is preferably such as to engage the plug 38 with the plug fully seated within the corresponding outlet 26. In this manner, not only is full withdrawal of the plug prevented, but also the possibility of partial removal of the plug is avoided, thus ensuring a continuous positive electrical connection.

As will be recognized from FIG. 4, the conventional tapered nature of the plug 38 may result in a partial extension of the plug outward beyond the aperture 36. However, this will in no way affect the seated locking of the plug within the outlet.

The face panel 18, in alignment with the second outlet 26 and in an area wherein the tapered chamber 16 is of a reduced depth relative to the face plate 12, is provided with a second aperture 42 therethrough. This second aperture 42 directly aligns with the second receptacle outlet 26 and is of a size to permit free passage of an electrical plug 38 therethrough and into the aligned outlet. Thus, while the safety cover 10 provides for a positive lock of one appliance plug within the wall receptacle, it also provides for accommodation of readily removable plug for temporary use of an appliance such as a vacuum cleaner, hair dryer or the like. The tapered nature of the chamber 16, and the reduced depth thereof in alignment with the second outlet arising from the inclination of the face panel 18 is particularly significant in providing for projection of a sufficient portion of the plug beyond the safety cover 10 to allow for free access to the plug for complete manipulation thereof as the plug is both inserted and removed from the corresponding outlet. The reduced depth of the chamber in alignment with the second outlet, while allowing free access to the plug, also provides a degree of protection, defined by the depth of the chamber, for a partially withdrawn plug. Thus, the safety cover 10 is uniquely configured to both lock one plug into a corresponding outlet against any possibility of removal, and at the same time maintain the companion or second outlet unencumbered for use in a conventional manner. This is done utilizing a single rigid cover plate which completely encloses and aesthetically conceals the conventional receptacle and face plate.

Figure 5:
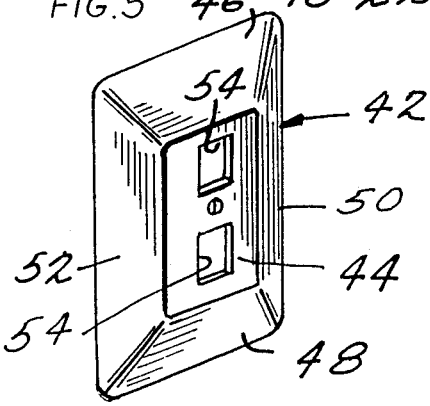
FIG. 5 is a perspective view of another embodiment of the safety cover.

Noting the embodiment of FIG. 5, in those instances wherein it might be desired to lock or safely retain two plugs in the duplex receptacle, the safety cover 42 can be provided with a constant depth internal chamber defined by a forwardly positioned face panel 44 parallel to the plane of the base edge 17 and by equal depth inclined side panels 46, 48, 50 and 52 peripherally thereabout. Both plug-accommodating apertures 54 will duplicate the above-described aperture 36, that is present an oblong or elongate configuration which requires a specific alignment of the plug for passage therethrough and a subsequent rotation of the plug for engagement within the corresponding outlet prior to a mounting of the safety cover 42. Again, no accidental removal or partial withdrawal of the plugs will be possible in that release of the cover or the retained plugs requires the specific use of a screw driver and the manipulation thereof in a manner which inherently avoids accidental removal, or in fact, even intentionally removal by a young child.

Variations and further modifications may occur to those skilled in the art, and as such, it is not desired to limit the invention to the exact construction shown. Rather, the invention is only to be limited by the scope of the claims appearing hereinafter.

We claim:

1. For use in conjunction with a wall-mounted electrical receptacle with dual outlets for the selective reception of electrical plugs conventionally formed to present an oblong shape with the longer dimension thereof alignable with the outlets for engagement of the plugs therewith; a one-piece, rigid safety cover, said cover including a peripheral base edge defining a base plane and being engageable with the wall about the electrical receptacle and means for mounting said cover to said receptacle, said cover inward of said base edge being laterally offset from the plane of said edge and defining a chamber adapted to receive a outlet-engaged plug, said cover including an opening defined therethrough and into said chamber for alignment with a first receptacle outlet upon a mounting of the cover to the receptacle, said opening being oblong and complementary to a conventional oblong-configured plug for free passage of the plug therethrough and into said chamber upon alignment of the plug and opening, and for precluding withdrawal of said plug from said chamber upon rotation of said plug out of alignment with said opening, said oblong opening, upon a mounting of the cover to the receptacle, having the longer dimension thereof extending transverse of the aligned first outlet whereby rotation of said plug subsequent to passage of the plug through the opening and into chamber will be required prior to engagement of the plug in the aligned outlet and will preclude withdrawal of said plug out of said chamber through said opening, said chamber being of a depth outward of said aligned first outlet to receive and return at least a portion of the plug between the cover and the aligned outlet.

2. The safety cover of claim 1 wherein the defined chamber, outward of the second receptacle outlet, is of a depth substantially less than the depth of said chamber outward of said first outlet, said cover in alignment with said second receptacle outlet having a second opening defined therethrough into said chamber and in alignment with said second outlet, said second opening being dimensioned for free non-rotational passage of a plug therethrough and into the aligned second outlet.

3. The safety cover of claim 2, wherein the depth of said chamber in alignment with said second outlet, in conjunction with the size of the second cover opening, is such as to expose a major portion of the plug upon engagement of the plug within the second outlet.

4. The safety cover of claim 3 including a face panel laterally offset from the plane of the base edge and oriented in a plane angularly directed relative to the plane of the base edge to define a varying depth to the chamber between a generally maximum depth portion aligned with the first outlet and a generally minimum depth portion aligned with the second outlet.

5. The safety cover of claim 4 including inclined panels integral with said face panel peripherally thereabout and extending between said face panel and said peripheral base edge at outwardly diverging angles, said top panel being peripherally inwardly spaced from the peripheral base edge.

6. The safety cover of claim 5 wherein said peripheral base edge defines a rectangular configuration, said face panel, in plan, being of a generally trapezoidal configuration with the lesser transverse width portion thereof generally aligned with the first outlet and the greater transverse width portion thereof generally aligned with the second outlet.

7. The safety cover of claim 2 including a face panel laterally offset from the plane of the base edge and oriented in a plane angularly directed relative to the plane of the base edge to define a varying depth to the chamber between a generally maximum depth portion aligned with the first outlet and a generally minimum depth portion aligned with the second outlet.

8. The safety cover of claim 1 wherein said means for mounting said cover to said receptacle includes an extension comprising a threaded shaft adapted to engage through and mount the conventional face plate of a wall-mounted electrical receptacle, and an enlarged head rigid with said shaft and extending therefrom outwardly to span the depth of the chamber, said head including an outer end against which the safety cover engages, and an internally threaded bore extending inwardly through said outer end, and a mounting screw engageable through said cover and into said internally threaded bore.

9. The safety cover of claim 1 wherein said chamber is of a constant depth outward of both outlets, said cover including a second opening defined therethrough and into said chamber for alignment with the second receptacle outlet upon a mounting of the cover to the receptacle, said second opening being oblong and complementary to a conventional electrical plug for free passage of the plug through the second opening and into said chamber upon a rotational alignment of the plug with the said opening, and for precluding withdrawal of said plug from said chamber upon rotation of said plug out of alignment with said second opening, reception of said plug within said second outlet requiring rotation of said plug, subsequent to introduction into said chamber, out of alignment with said second opening whereby said plug, upon insertion through said second opening and a mounting of the safety cover, is precluded from withdrawal from said second opening.

10. For use in conjunction with a wall-mounted electrical receptacle with dual outlets for the selective reception of a conventionally formed electrical plug; a one-piece rigid safety cover, said cover including a peripheral edge defining a base plane and being engageable with the wall about the electrical receptacle, and means for mounting said cover to said receptacle, said cover, inward of said peripheral edge, being laterally offset from the plane of said base edge and defining a chamber adapted to receive an outlet-engaged plug, said cover including an opening defined therethrough and into said chamber for alignment with one receptacle outlet upon a mounting of the cover to the receptacle, said plug being rotatable between a complementary position relative to said opening for free passage of the plug therethrough and into said chamber, and a non-complementary position, rotated from said complementary position, precluding withdrawal of said plug from said chamber, said plug, in the non-complementary position within the chamber of the mounted cover, being engageable within said one receptacle outlet, the depth of said chamber being such whereby rotation of said plug subsequent to passage of the plug through the opening and into said chamber will be required prior to engagement of the plug into the outlet and prior to mounting the cover, and will preclude withdrawal of said plug from the outlet upon a mounting of said cover.

11. The safety cover of claim 10 wherein said chamber is of a tapered configuration defined by a face panel laterally spaced from and inclined relative to the plane of said base edge, said tapered chamber, upon a mounting of the safety cover over a dual outlet receptacle, providing a generally maximum depth chamber portion aligned with said one outlet receptacle and a generally minimum depth portion aligned with the second outlet.

12. The safety cover of claim 10 wherein said chamber is of a constant depth over both receptacle outlets, said cover including a second opening defined therethrough and into said chamber for alignment with the second receptacle outlet, said second opening duplicating said first opening.

13. The safety cover of claim 10 wherein said opening and said plug have complementary major axes which upon alignment define the complementary position.

* * * * *